US010196256B2

(12) United States Patent
Yajima et al.

(10) Patent No.: US 10,196,256 B2
(45) Date of Patent: Feb. 5, 2019

(54) BEVERAGE SUPPLY DEVICE

(71) Applicant: PANASONIC INTELLECTUAL PROPERTY MANAGEMENT CO., LTD., Osaka (JP)

(72) Inventors: Kazuya Yajima, Gunma (JP); Masahiro Kamiyama, Saitama (JP); Yasuhiro Imazeki, Gunma (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/522,057

(22) PCT Filed: Oct. 27, 2015

(86) PCT No.: PCT/JP2015/005401
§ 371 (c)(1),
(2) Date: Apr. 26, 2017

(87) PCT Pub. No.: WO2016/067604
PCT Pub. Date: May 6, 2016

(65) Prior Publication Data

US 2017/0313569 A1 Nov. 2, 2017

(30) Foreign Application Priority Data

Oct. 31, 2014 (JP) ..... 2014-223605

(51) Int. Cl.
*B67D 1/08* (2006.01)
*B67D 1/12* (2006.01)

(52) U.S. Cl.
CPC ..... *B67D 1/12* (2013.01); *B67D 1/08* (2013.01); *B67D 1/0888* (2013.01)

(58) Field of Classification Search
CPC ..... B67D 1/0888
(Continued)

(56) References Cited

U.S. PATENT DOCUMENTS 2,808,179 A * 10/1957 McIntyre ..... B67D 3/0003 141/291
3,447,720 A * 6/1969 Janigian ..... B67D 3/00 221/152

(Continued)

FOREIGN PATENT DOCUMENTS

JP 2000-276649 A 10/2000

OTHER PUBLICATIONS

International Search Report and Written Opinion issued in International Patent Application No. PCT/JP2015/005401, dated Jan. 26, 2016; with partial English translation.

*Primary Examiner* — Patrick M. Buechner
(74) *Attorney, Agent, or Firm* — McDermott Will & Emery LLP

(57) ABSTRACT

A beverage supply device is provided with: physical buttons (3*a*) to (3*c*) for receiving an indicator operation indicating that a beverage selected from among the plurality of types of beverages is to be supplied; a control unit that causes a selected beverage to be discharged from a predetermined nozzle while one of the physical buttons (3*a*) to (3*c*) is receiving an indicator operation; and a storage unit that stores the number of sales for each beverage. The control unit increases the number of sales for a beverage by one sale when the same beverage is supplied continuously and the interval during which the beverage is supplied continuously is longer than a predetermined period. The control unit does not increase the number of sales for a beverage when the interval during which the beverage is supplied continuously is shorter than a predetermined period.

2 Claims, 15 Drawing Sheets

(58) Field of Classification Search
USPC ..... 705/22, 28; 222/36, 37
See application file for complete search history.

(56) References Cited

U.S. PATENT DOCUMENTS 3,638,392 A * 2/1972 Welker, Jr. ..... G07F 13/065 141/104
3,809,866 A * 5/1974 Scoville ..... B67D 7/228 222/33
4,034,193 A * 7/1977 Jackson ..... B67D 7/103 222/36
4,800,492 A * 1/1989 Johnson ..... B67D 1/0041 222/23
5,022,557 A * 6/1991 Turner ..... B67D 1/0855 222/54
5,244,119 A * 9/1993 Pittman ..... B67D 1/06 222/25
5,255,819 A * 10/1993 Peckels ..... B67D 3/0041 222/1
5,505,349 A * 4/1996 Peckels ..... B67D 3/0041 222/36
5,540,102 A * 7/1996 Kindrick ..... A01M 7/0089 222/36
5,603,430 A * 2/1997 Loehrke ..... B67D 1/0888 222/1
5,702,032 A * 12/1997 Loehrke ..... B67D 3/0006 222/63
6,409,046 B1 * 6/2002 Peckels ..... B67D 3/0041 222/1
2002/0060226 A1 * 5/2002 Kameyama ..... B67D 1/0037 222/1
2013/0204754 A1 * 8/2013 Brelig ..... G06Q 10/0875 705/29
2014/0346198 A1 * 11/2014 Bond ..... G01F 11/265 222/641
2015/0144652 A1 * 5/2015 Kline ..... B67D 1/0888 222/1
2016/0090288 A1 * 3/2016 Givens, Jr. ..... B67D 1/0041 700/283
2017/0249796 A1 * 8/2017 Lee ..... G07F 17/0035
2017/0313569 A1 * 11/2017 Yajima ..... B67D 1/12

* cited by examiner

| BRAND | PHYSICAL BUTTON |
| --- | --- |
| D | 3a |
| G | 3c |
| A, B, C, E, F, H, I, J, WATER, CARBONATED WATER | 3b |

FIG. 5

| DATA ID | SUPPLY START DATE AND TIME | SUPPLY END DATE AND TIME | BEVERAGE ID | FRUIT AMOUNT INCREASING FLAG | SUPPLY AMOUNT |
|---|---|---|---|---|---|
| ⋮ | ⋮ | ⋮ | ⋮ | ⋮ | ⋮ |
| 10 | 2014/07/10 10:59:03 | 2014/07/10 10:59:13 | 001 | 0 | 200 |
| 11 | 2014/07/10 11:00:15 | 2014/07/10 11:00:28 | 003 | 0 | 260 |
| 12 | 2014/07/10 11:00:38 | 2014/07/10 11:00:51 | 003 | 0 | 260 |
| 13 | 2014/07/10 11:00:54 | 2014/07/10 11:00:58 | 003 | 0 | 80 |
| 14 | 2014/07/10 11:01:02 | 2014/07/10 11:01:10 | 003 | 0 | 160 |
| ⋮ | ⋮ | ⋮ | ⋮ | ⋮ | ⋮ |
| 120 | 2014/07/10 11:59:37 | 2014/07/10 10:59:40 | 005 | 1 | 180 |
| ⋮ | ⋮ | ⋮ | ⋮ | ⋮ | ⋮ |

FIG. 14

| DATA ID | COUNTING PERIOD | BEVERAGE ID | CUMULATIVE NUMBER OF SALES |
|---|---|---|---|
| 1 | 2014/07/10 11:00:00 ~ 2014/07/10 12:00:00 | 001 | 16 |
| | | 002 | 24 |
| | | 003 | 58 |
| | | ⋮ | ⋮ |

FIG. 15

BEVERAGE SUPPLY DEVICE

RELATED APPLICATIONS

This application is the U.S. National Phase under 35 U.S.C. § 371 of International Patent Application No. PCT/JP2015/005401, filed on Oct. 27, 2015, which in turn claims the benefit of Japanese Application No. 2014-223605, filed on Oct. 31, 2014, the disclosures of which Applications are incorporated by reference herein.

TECHNICAL FIELD

The present invention relates to a beverage supplying apparatus that supplies a beverage.

BACKGROUND ART

Conventionally, beverage supplying apparatuses are known which produce a beverage by mixing a syrup with diluted water and/or carbonated water and supply the produced beverage. Such beverage supplying apparatuses can normally produce and supply a plurality of types of beverages.

More specifically, a beverage supplying apparatus is provided with a physical button for receiving an operation for selecting a beverage to be produced, and discharges, when the physical button is pressed, a syrup necessary to produce the beverage from among different types of syrups respectively stored in a plurality of syrup tanks. At the same time, the beverage supplying apparatus discharges diluted water and/or carbonated water and produces a beverage by mixing the syrup with the diluted water and/or carbonated water.

Furthermore, a beverage supplying apparatus that displays a cumulative sales amount counted for each beverage is also being proposed (e.g., see Patent Literature (hereinafter referred to as "PTL") 1). The beverage supplying apparatus totals a discharge time for each beverage, and calculates and displays a cumulative sales amount of each beverage based on the totaled discharge time and a discharge amount per unit time set for each beverage. It is thereby possible to easily grasp which beverage sells well.

CITATION LIST

Patent Literature

PTL 1
Japanese Patent Application Laid-Open No. 2000-276649

SUMMARY OF INVENTION

Technical Problem

However, the aforementioned related art sometimes has a difficulty in accurately grasping the popularity of a beverage. When, for example, a sales amount per sale of beverage A is greater than a sales amount per sale of beverage B, even when, for example, the number of customers purchasing beverage A is the same as the number of customers purchasing beverage B, a cumulative sales amount of beverage A is greater than a cumulative sales amount of beverage B.

In this case, since the same number of customers purchase beverage A and beverage B, the popularity of beverages is considered the same for beverage A and beverage B, but it is difficult to judge that from the cumulative sales amount.

Thus, there is a strong demand for development of a technique capable of more accurately grasping the popularity of a beverage.

The present invention has been implemented to solve the above problem and an object of the present invention is to provide a beverage supplying apparatus capable of more accurately grasping the popularity of a beverage.

Solution to Problem

A beverage supplying apparatus according to the present invention is an apparatus that supplies a plurality of types of beverages, the apparatus including: a button for receiving an instruction operation for instructing supply of a beverage selected from among the plurality of types of beverages; a control section that causes the selected beverage to be discharged from a predetermined nozzle while the button is receiving the instruction operation; and a storage section that stores the number of sales for each beverage, in which: the control section increments the number of sales for the beverage by one sale when the same beverage is supplied continuously and an interval during which the beverage is supplied continuously is longer than a predetermined period, and the control section does not increment the number of sales for the beverage when the interval during which the beverage is supplied continuously is shorter than the predetermined period.

A beverage supplying apparatus according to the present invention is an apparatus that supplies a plurality of types of beverages, the apparatus including: a button for receiving an instruction operation for instructing a supply of a beverage selected from among the plurality of types of beverages; a control section that causes the selected beverage to be discharged from a predetermined nozzle while the button is receiving the instruction operation; and a storage section that stores the number of sales for each beverage, in which: the control section increments the number of sales for the beverage by one sale when the same beverage is supplied continuously and an interval during which the beverage is supplied continuously is longer than a predetermined period, and the interval during which the beverage is supplied continuously is shorter than the predetermined period and the total amount of the beverage supplied continuously exceeds a predetermined value, and the control section does not increment the number of sales for the beverage when the interval during which the beverage is supplied continuously is shorter than the predetermined period and the total amount of the beverage supplied continuously is less than the predetermined value.

Advantageous Effects of Invention

According to the present invention, it is possible to more accurately grasp the popularity of a beverage.

BRIEF DESCRIPTION OF DRAWINGS

FIG. 5 is a diagram illustrating a table used to control the beverage supplying apparatus according to the embodiment of the present invention;

FIG. 14 is a diagram illustrating an example of history data generated by the beverage supplying apparatus according to the embodiment of the present invention; and FIG. 15 is a diagram illustrating an example of counting data generated by the beverage supplying apparatus according to the embodiment of the present invention.

DESCRIPTION OF EMBODIMENTS

Hereinafter, an embodiment of the present invention will be described with reference to the accompanying drawings.

Figure 1:
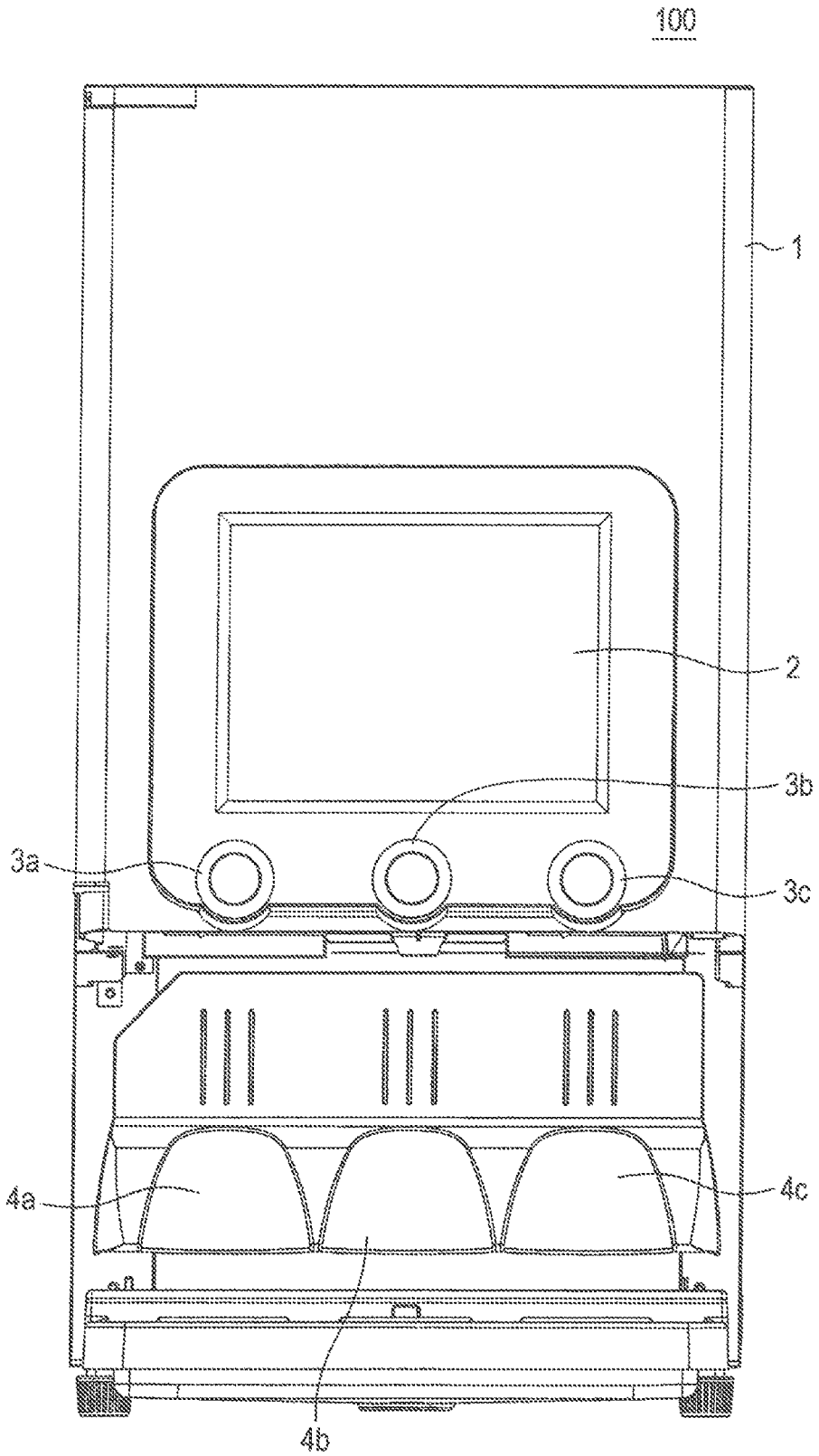
FIG. 1 is a front view of a beverage supplying apparatus according to an embodiment of the present invention.
Figure 2:
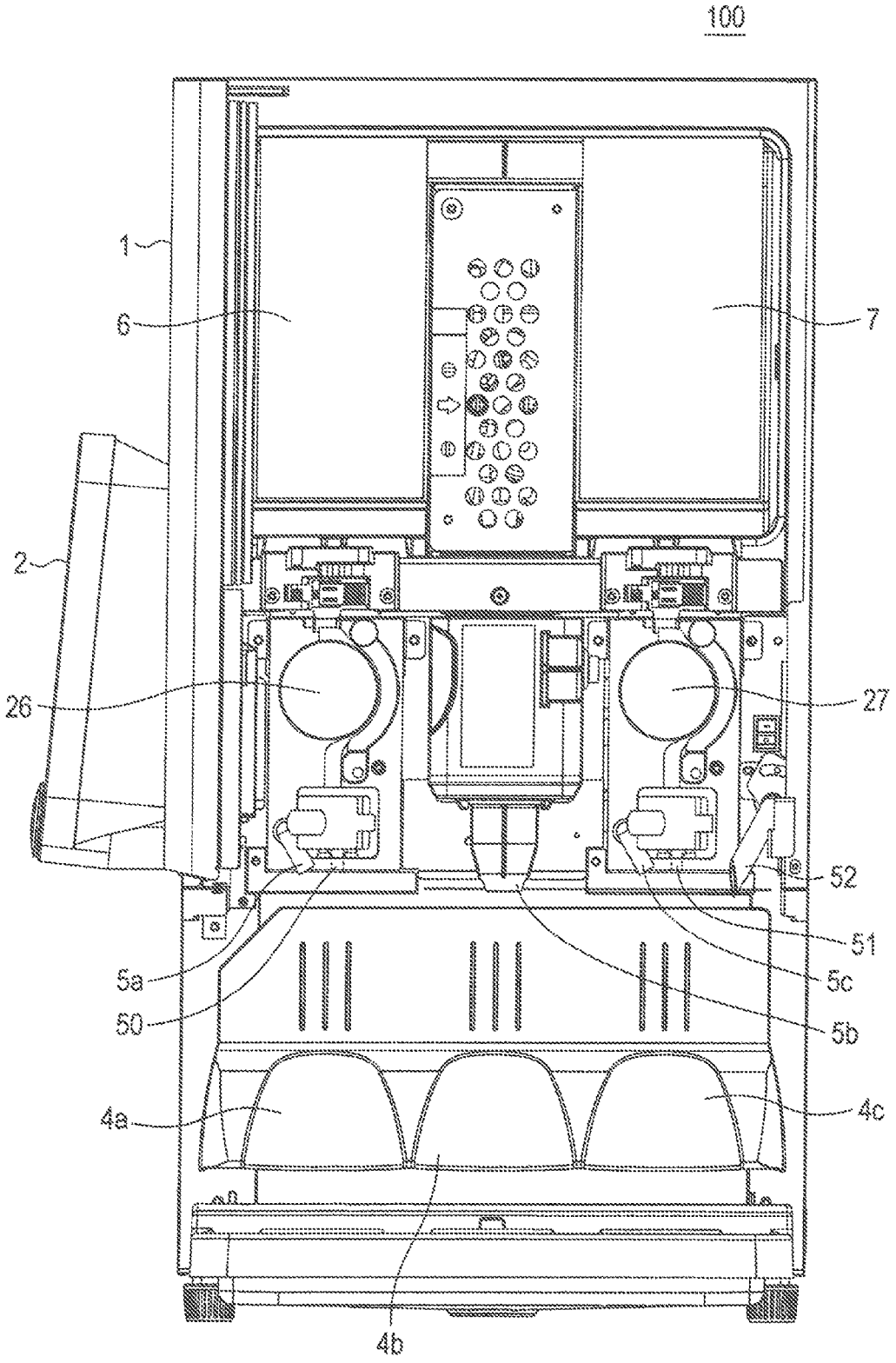
FIG. 2 is a front view illustrating an interior of the beverage supplying apparatus according to the embodiment of the present invention when a front door is opened.
Figure 3:
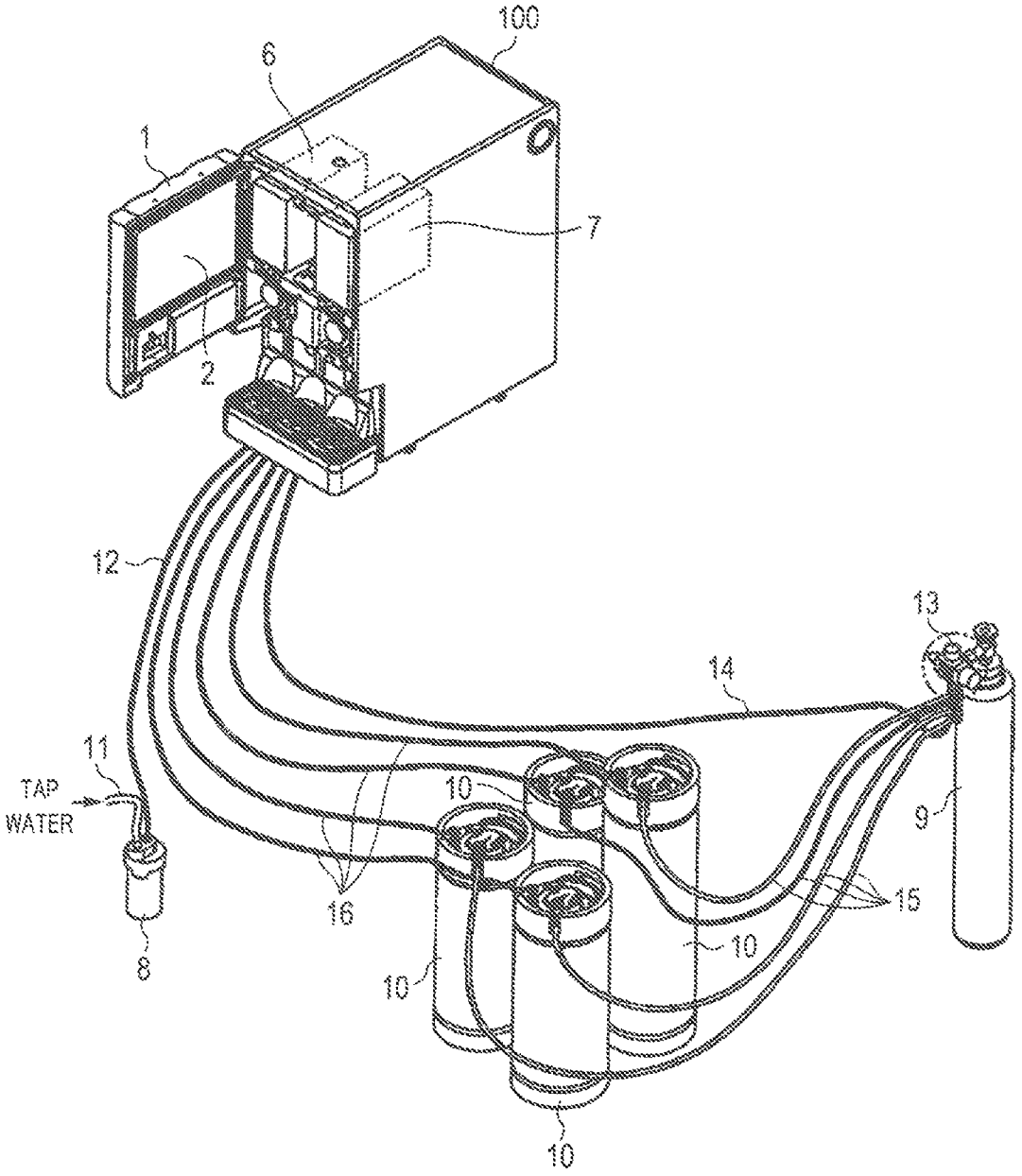
FIG. 3 is a diagram illustrating an external configuration of the beverage supplying apparatus according to the embodiment of the present invention.

First, a configuration example of beverage supplying apparatus 100 according to an embodiment of the present invention will be described using FIG. 1 to FIG. 3. FIG. 1 is a front view of beverage supplying apparatus 100 according to an embodiment of the present invention; FIG. 2 is a front view of beverage supplying apparatus 100 according to the embodiment of the present invention, illustrating an interior thereof when a front door is opened. FIG. 3 is a diagram illustrating an external configuration of the beverage supplying apparatus according to the embodiment of the present invention.

As shown in FIG. 1, beverage supplying apparatus 100 is provided with touch panel 2 on front door 1 that can be opened/closed. Touch panel 2 is an operation receiving section that displays beverage choices for a user of beverage supplying apparatus 100 and receives an operation for selecting a beverage by the user.

More specifically, touch panel 2 displays choices for a main syrup constituting a main beverage and diluted with diluted water and/or carbonated water and choices for a topping syrup added to the main beverage as a flavor, and performs processing of receiving an operation for selecting the main syrup and the topping syrup from the user. Details of touch panel 2 will be described later.

As shown in FIG. 1, physical buttons 3*a* to 3*c* are provided at lower parts of touch panel 2. Physical buttons 3*a* to 3*c* receive an operation for instructing discharge of a beverage from the user. Container placement areas 4*a* to 4*c* for the user to place a container (glass, cup, or the like) are provided below physical buttons 3*a* to 3*c*.

Physical button 3*a* corresponds to container placement area 4*a*, and also corresponds to diluted water nozzle 5*a* and syrup nozzle 50 shown in FIG. 2. Furthermore, physical button 3*b* corresponds to container placement area 4*b*, and also corresponds to nozzle 5*b* shown in FIG. 2. Physical button 3*c* corresponds to container placement area 4*c*, and also corresponds to diluted water nozzle 5*c*, syrup nozzle 5 and carbonated water nozzle 52 shown in FIG. 2.

The user performs an operation for selecting a beverage on touch panel 2, then places a container at one of container placement areas 4*a* to 4*c* and presses one of physical buttons 3*a* to 3*c*.

When, for example, physical button 3*a* is pressed, a syrup in bag-in-box (hereinafter referred to as "BIB") 6 shown in FIG. 2 is discharged from syrup nozzle 50 via BIB tube pump 26 and becomes a discharge flow. This syrup discharge flow collides and is mixed with a discharge flow of diluted water discharged from diluted water nozzle 5*a*. A beverage is thus produced. The beverage produced in this way is supplied to a container placed at container placement area 4*a*.

When, for example, physical button 3*b* is pressed, a syrup is mixed with diluted water and/or carbonated water at nozzle 5*b* and a beverage is thus produced. The beverage produced in this way is discharged from nozzle 5*b* and supplied to a container placed at container placement area 4*b*.

When, for example, physical button 3*c* is pressed, a syrup in BIB 7 shown in FIG. 2 is discharged from syrup nozzle 51 via BIB tube pump 27 and becomes a discharge flow. This syrup discharge flow collides and is mixed with a discharge flow of diluted water discharged from diluted water nozzle 5*c* and/or a discharge flow of carbonated water discharged from carbonated water nozzle 52. A beverage is thus produced. The beverage produced in this way is supplied to a container placed at container placement area 4*c*.

Note that each aforementioned beverage is supplied to each container while physical button 3*a* to 3*c* is being pressed.

Aforementioned carbonated water nozzle 52 may be provided on a BIB 6 side or may be provided on both BIB 6 and BIB 7 sides.

Aforementioned BIBs 6 and 7 are provided in a refrigerating area. BIBs 6 and 7 store syrups requiring cool storage. Syrups not requiring cool storage are stored in syrup tank 10 which will be described later using FIG. 3.

Syrups referred to here in the present embodiment are assumed to include not only condensed liquid containing sugar but also condensed liquid not containing sugar (e.g., stock solution of green tea or tea).

Aforementioned nozzle 5*b* is a mixing section that produces a main beverage by mixing diluted water and/or carbonated water with a main syrup at a prescribed ratio and produces a beverage by mixing an undiluted topping syrup with the main beverage (hereinafter referred to as "flavor-added beverage"). The flavor-added beverage produced at nozzle 5*b* is discharged from nozzle 5*b* into a container placed at container placement area 4*b*.

Mixing two kinds of syrups, that is, main syrup and topping syrup, can drastically increase the number of beverage flavor choices to be provided to the user.

Here, the main syrup and the topping syrup are stored in syrup tanks 10 shown in FIG. 3 which will be described below. Note that nozzle 5*b* also discharges, in addition to the above flavor-added beverage, water only or carbonated water only.

Furthermore, as shown in FIG. 3, beverage supplying apparatus 100 is provided with cleaning filter 8, carbon dioxide gas cylinder 9 and a plurality of syrup tanks 10.

Cleaning filter 8 cleans tap water supplied from blade tube 11 and supplies the cleaned water into beverage supplying apparatus 100 via blade tube 12. The water cleaned here is used as diluted water to be mixed with a syrup or supplied to the user as drinking water. Blade tube 12 is connected, for example, to a carbonator (not shown) provided inside beverage supplying apparatus 100, diluted water nozzles 5*a* and 5*c*, and nozzle 5*b*.

Carbon dioxide gas cylinder 9 stores a carbon dioxide gas. This carbon dioxide gas is supplied to carbonator 23 via blade tube 14 at a prescribed pressure (e.g., 0.6 MPa) set in gas regulator 13. This carbon dioxide gas is further supplied to each syrup tank 10 via blade tube 15 at a prescribed pressure (e.g., 0.2 MPa) set in gas regulator 13.

Plurality of syrup tanks 10 store different syrups. As described above, these syrups are used as a main syrup or topping syrup. These syrups are pushed out under a pressure of the gas supplied from carbon dioxide gas cylinder 9 and supplied to nozzle 5*b* via blade tube 16.

Figure 4:
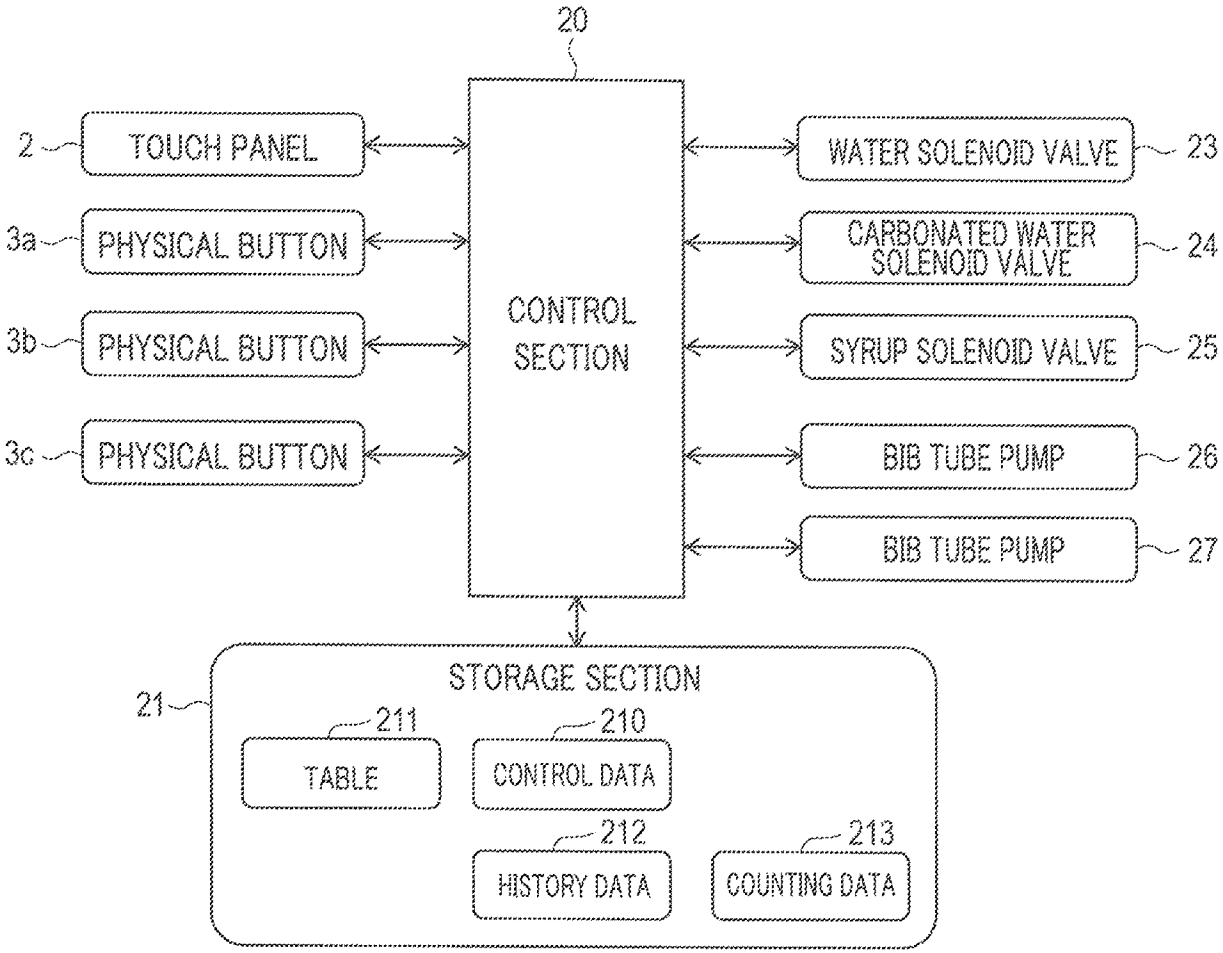
FIG. 4 is a functional block diagram of the beverage supplying apparatus according to the embodiment of the present invention.

Next, a configuration of control section 20 and peripheral parts thereof of beverage supplying apparatus 100 according to the embodiment of the present invention will be described using FIG. 4. FIG. 4 is a functional block diagram of beverage supplying apparatus 100 according to the embodiment of the present invention.

Beverage supplying apparatus 100 is provided with control section 20, storage section 21, water solenoid valve 23, carbonated water solenoid valve 24, syrup solenoid valve 25, and BIB tube pumps 26 and 27 in addition to touch panel 2, and physical buttons 3*a* to 3*c* described in FIG. 1.

Control section 20 is a control device such as a CPU (central processing unit). Control section 20 controls each functional section provided for beverage supplying apparatus 100. Storage section 21 is a memory device such as a ROM (read only memory) or RAM (random access memory). Storage section 21 stores table 211, control data 210, history data 212, counting data 213 or the like which will be described later.

Control section 20 controls touch panel 2, controls a beverage supply or counts the number of sales of a beverage based on the data read from storage section 21. Control of touch panel 2 and counting of the number of sales of a beverage will be described in detail later. Here, supply control of a beverage will be described first.

When the user performs an operation for selecting a beverage on touch panel 2, control section 20 reads control data 210 relating to supply control of the selected beverage from storage section 21 and supplies the beverage based on read control data 210. Examples of such control data 210 include data on a dilution ratio among diluted water, carbonated water, main syrup and topping syrup, setting data for controlling opening/closing of each solenoid valve (water solenoid valve 23, carbonated water solenoid valve 24, syrup solenoid valve 25) in accordance with the dilution ratio and setting data for controlling driving of BIB tube pumps 26 and 27.

Note that a case will be described hereinafter where supply control of water, carbonated water, main syrup and topping syrup is performed through opening/closing of each solenoid valve, but supply control may also be performed using a pump or the like.

When the user performs an operation for selecting a beverage on touch panel 2, control section 20 reads table 211 from storage section 21. Table 211 is information indicating physical button 3*a* to 3*c* corresponding to the beverage selected by the user.

An example of this table 211 is shown in FIG. 5. As shown in FIG. 5, table 211 registers information on physical buttons 3*a* to 3*c* in association with beverage brands, physical buttons 3*a* to 3*c* corresponding to nozzles from which beverages of the brands are discharged respectively. Note that FIG. 5 shows brands using alphabetical letters.

For example, table 211 associates brand D with physical button 3*a*. Thus, when the user selects a beverage of brand D and presses physical button 3*a*, the beverage of brand D produced as described above is supplied to a container placed at container placement area 4*a* corresponding to physical button 3*a*.

Furthermore, table 211 associates brand G with physical button 3*c*. Thus, when the user selects a beverage of brand G and presses physical button 3*c*, the beverage of brand G produced as described above is supplied to a container placed at container placement area 4*c* corresponding to physical button 3*c*.

Furthermore, table 211 associates brands A to C, E, F, H to J, water (beverage water) and carbonated water with physical button 3*b*. Thus, when the user selects one beverage of brand A to C, E, F, H to J, water and carbonated water and presses physical button 3*b*, the beverage produced as described above (e.g., flavor-added beverage, water, carbonated water) is supplied to a container placed at container placement area 4*b* corresponding to physical button 3*b*. Note that water and carbonated water are not brands, but water and carbonated water will be handled as one type of brand in the present embodiment for convenience.

Upon detecting that one of physical buttons 3*a* to 3*c* is pressed, control section 20 controls at least one of opening/closing of solenoid valves 23 to 25 and driving of BIB tube pumps 26 and 27 and supplies water, carbonated water, main syrup or topping syrup to a nozzle corresponding to pressed physical button 3*a* to 3*c* (diluted water nozzle 5*a*, 5*c*, nozzle 5*b*, syrup nozzle 50, 51).

When, for example, the user selects one beverage of brand A to C, E, F, H to J and presses physical button 3*b*, control section 20 opens syrup solenoid valve 25 provided between syrup tank 10 storing the syrup (main syrup) of the selected brand and nozzle 5*b* and opens water solenoid valve 23 and/or carbonated water solenoid valve 24. Note that when opening water solenoid valve 23 and carbonated water solenoid valve 24, control section 20 causes water solenoid valve 23 and carbonated water solenoid valve 24 to be alternately opened, but control section 20 may also cause them to be simultaneously opened.

In this way, a syrup, diluted water and/or carbonated water are mixed at nozzle 5*b* and the beverage obtained as a result thereof is discharged from nozzle 5*b*.

Note that when the user selects a flavor-added beverage, control section 20 opens syrup solenoid valve 25 provided between syrup tank 10 storing a topping syrup with a flavor selected by the user (e.g., fruit flavor such as orange, grape)

and nozzle 5*b* in addition to syrup solenoid valve 25 provided between syrup tank 10 storing the main syrup and nozzle 5*b*.

This makes it possible to supply also the topping syrup to nozzle 5*b* in addition to the main syrup and produce a flavor-added beverage by mixing these syrups with diluted water and/or carbonated water.

On the other hand, when the user selects water and presses physical button 3*b*, control section 20 opens water solenoid valve 23 provided between cleaning filter 8 and nozzle 5*b*. This causes water to be discharged from nozzle 5*b*.

Furthermore, when the user selects carbonated water and presses physical button 3*b* corresponding to nozzle 5*b*, control section 20 opens carbonated water solenoid valve 24 provided between the carbonator and nozzle 5*b*. This causes carbonated water to be discharged from nozzle 5*b*.

Similarly, when the user selects a beverage of brand D and presses physical button 3*a*, control section 20 drives BIB tube pump 26 provided between BIB 6 storing the selected syrup of brand D and syrup nozzle 50 under a predetermined condition. Simultaneously, control section 20 opens water solenoid valve 23 and causes diluted water nozzle 5*a* to discharge diluted water.

This causes a beverage in which the syrup of brand D and diluted water are mixed together to be supplied to a container placed at container placement area 4*a*.

When the user selects a beverage of brand G and presses physical button 3*c*, control section 20 drives BIB tube pump 27 provided between BIB 7 storing the selected syrup of brand G and syrup nozzle 51 under a predetermined condition. Simultaneously, control section 20 opens water solenoid valve 23 and/or carbonated water solenoid valve 24 and causes diluted water nozzle 5*c* and/or carbonated water nozzle 52 to discharge diluted water and/or carbonated water.

This causes a beverage in which the syrup of brand G and diluted water and/or carbonated water are mixed together to be supplied to a container placed at container placement area 4*c*.

An example of supply control of a beverage executed by control section 20 has been described so far.

Next, a control example of screen display on touch panel 2 executed by control section 20 will be described using FIG. 6 to FIG. 9.

Here, a control example where, for example, a peach flavor beverage of brand A is selected will be described using FIG. 6 to FIG. 9. FIG. 6 to FIG. 9 are diagrams illustrating screen display examples of touch panel 2.

First, control section 20 reads image data of a home screen stored in storage section 21 and causes touch panel 2 to display the home screen.

Figure 6:
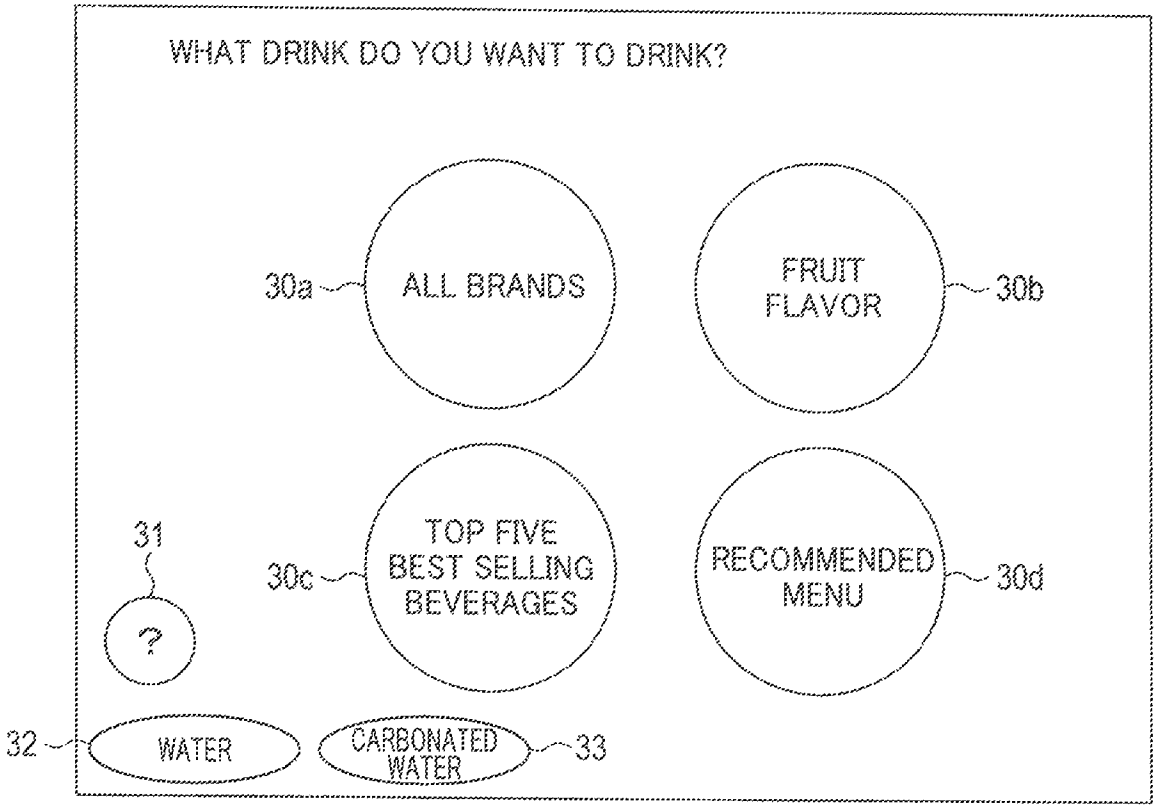
FIG. 6 is a diagram illustrating a display example of a home screen of the beverage supplying apparatus according to the embodiment of the present invention.

A display example of the home screen is shown in FIG. 6. As shown in FIG. 6, the home screen displays category selection buttons 30*a* to 30*d*, help button 31, water button 32 and carbonated water button 33.

Category selection buttons 30*a* to 30*d* are buttons for receiving a touch operation (hereinafter referred to as "pressing") by the user when the user selects a beverage category.

Help button 31 is a button to be pressed when the user wants to know a method of operating beverage supplying apparatus 100 (e.g., operation method for the screen currently being displayed). When help button 31 is pressed, control section 20 reads data on an operation method stored in storage section 21 and causes touch panel 2 to display the data.

Water button 32 is a button to be pressed by the user to select water as a beverage. Carbonated water button 33 is a button to be pressed by the user to select carbonated water as a beverage.

Here, suppose the user presses category selection button 30*a* and control section 20 receives an operation for selecting a category "all brand." In this case, control section 20 causes touch panel 2 to display all the brand selection buttons.

For example, control section 20 reads image data of the brand selection screen including all the brand selection buttons from storage section 21 and causes touch panel 2 to display the screen.

Figure 7:
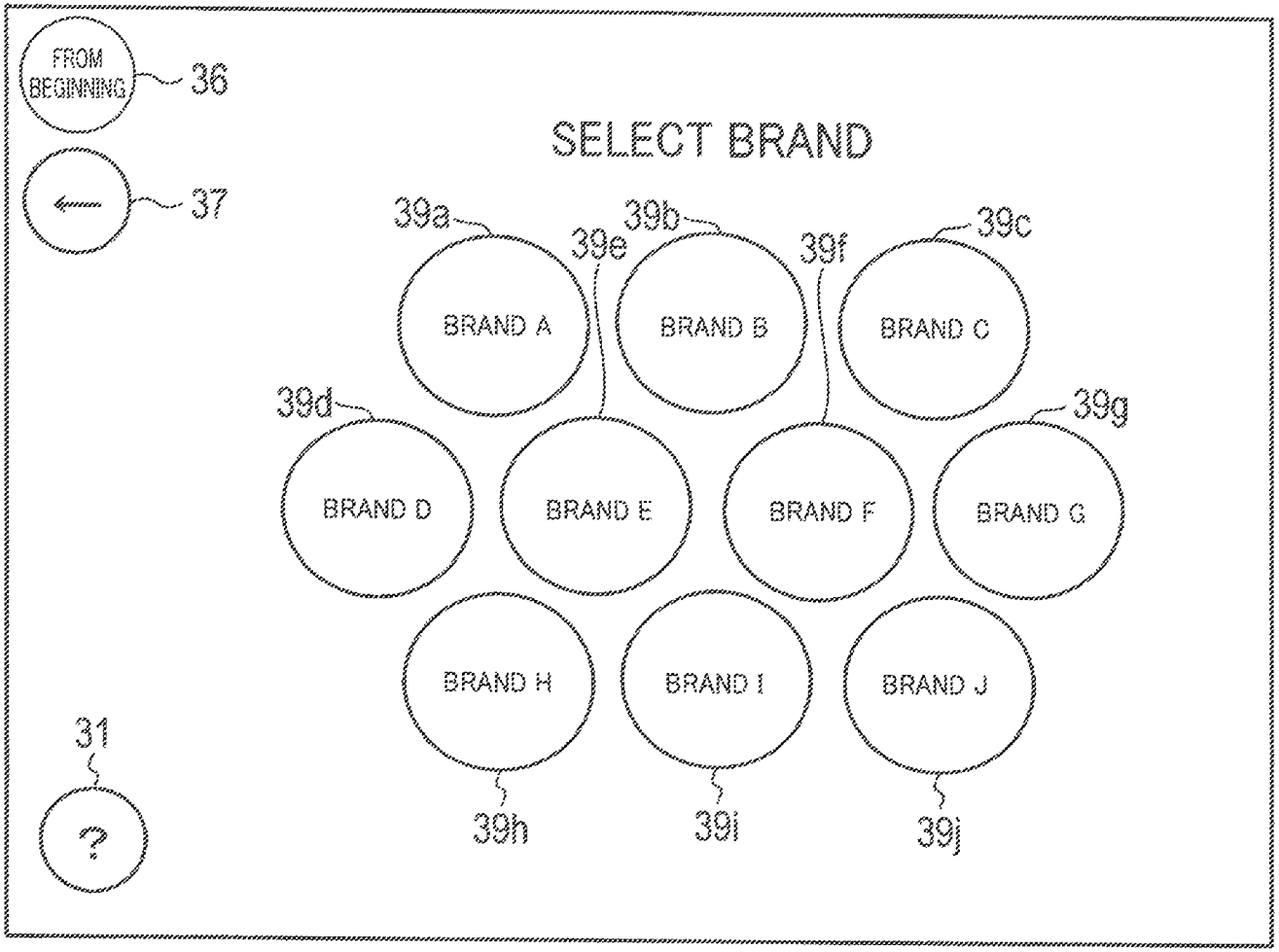
FIG. 7 is a diagram illustrating a display example of a brand selection screen according to the beverage supplying apparatus according to the embodiment of the present invention.

A display example of the brand selection screen is shown in FIG. 7. As shown in FIG. 7, this brand selection screen displays brand selection buttons 39*a* to 39*j*. Brand selection buttons 39*a* to 39*j* are buttons to be pressed by the user to select a beverage brand. Brand selection buttons 39*a* to 39*j* correspond to brands A to J shown in FIG. 5.

On the brand selection screen shown in FIG. 7, return buttons 36 and 37 are displayed at the upper left of the screen. Return button 36 is a button to be pressed when the user wants to return to the home screen. Return button 37 is a button to be pressed when the user wants to return to the last screen. When return button 36 or 37 is pressed, control section 20 causes the display screen to transition to the home screen or the last screen.

Here, suppose that the user presses one of brand selection buttons 39*a* to 39*j* and control section 20 thereby receives an operation for selecting a brand. Here, description will continue assuming that, for example, brand selection button 39*a* is pressed.

In this case, control section 20 specifies physical button 3*b* corresponding to a nozzle for supplying a beverage of selected brand A (in other words, a container placement area at which the user should place a container) based on table 211 read from storage section 21.

Control section 20 causes touch panel 2 to display the beverage selection button of selected brand A. For example, control section 20 reads image data of the beverage selection screen stored in storage section 21 and causes touch panel 2 to display the beverage selection screen.

Figure 8:
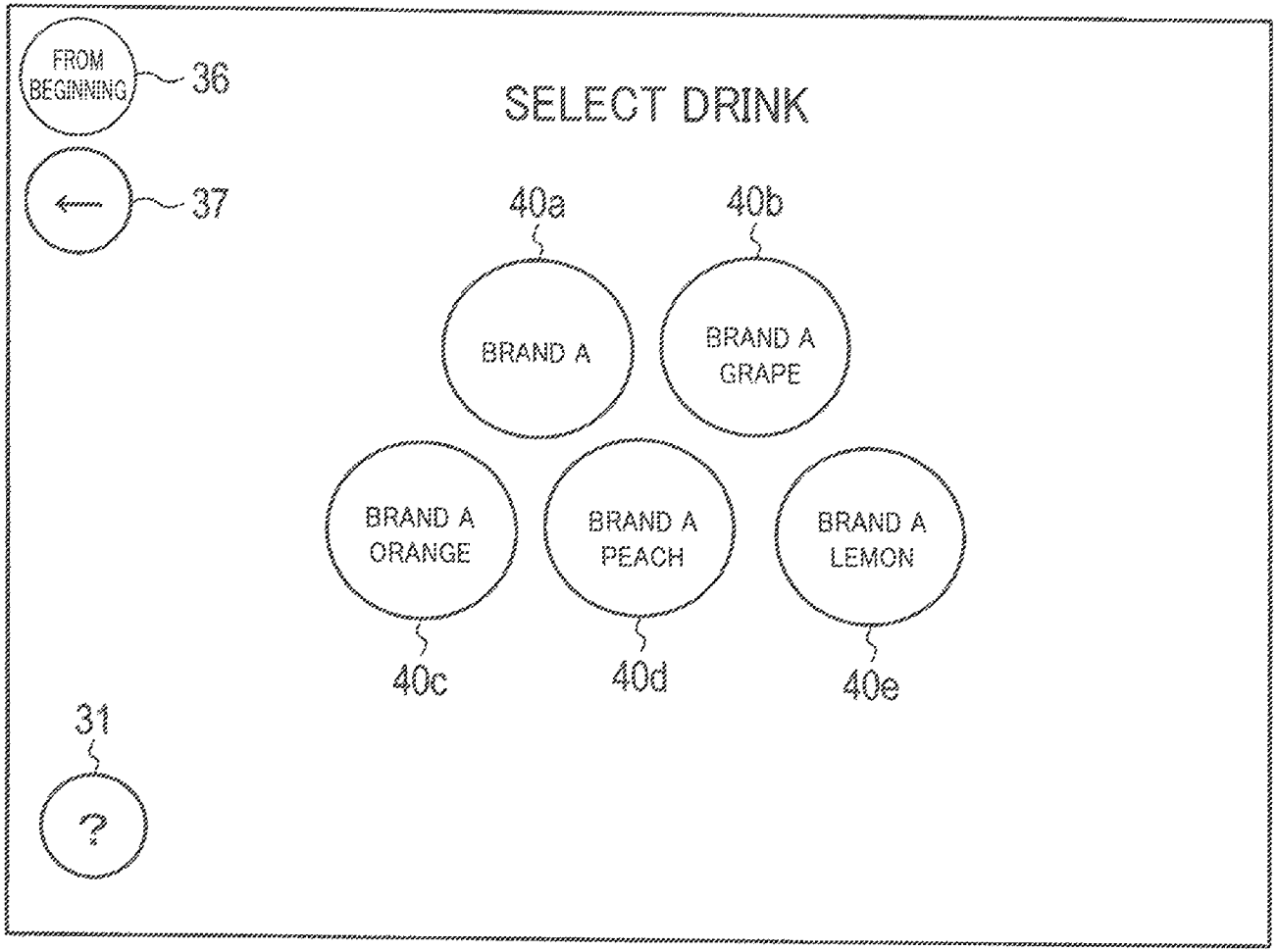
FIG. 8 is a diagram illustrating a display example of a beverage selection screen according to the beverage supplying apparatus according to the embodiment of the present invention.

A display example of the beverage selection screen is shown in FIG. 8. As shown in FIG. 8, the beverage selection screen displays beverage selection buttons 40*a* to 40*e*. Beverage selection buttons 40*a* to 40*e* are buttons to be pressed by the user to select a beverage.

Here, a beverage selected by pressing of beverage selection button 40*a* is a beverage in which the syrup of brand A and diluted water and/or carbonated water are mixed together.

A beverage selected by pressing of one of beverage selection buttons 40*b* to 40*e* is a beverage in which the syrup of brand A (main syrup), water and/or carbonated water and a syrup with a fruit flavor (topping syrup) are mixed together (that is, flavor-added beverage). In the example in FIG. 8, the fruit flavor is one of grape, orange, peach and lemon.

Here, suppose that one of beverage selection buttons 40*a* to 40*e* is pressed and control section 20 thereby receives an operation for selecting a beverage. Here, description will continue assuming that, for example, beverage selection button 40*d* is pressed.

In this case, control section 20 causes touch panel 2 to display an instruction for pressing physical button 3*b* corresponding to nozzle 5*b* from which a beverage is discharged (in other words, container placement area 4*b*). For example, control section 20 reads image data for an instruction for pressing physical button 3*b* from storage section 21 and causes touch panel 2 to display the image.

Figure 9:
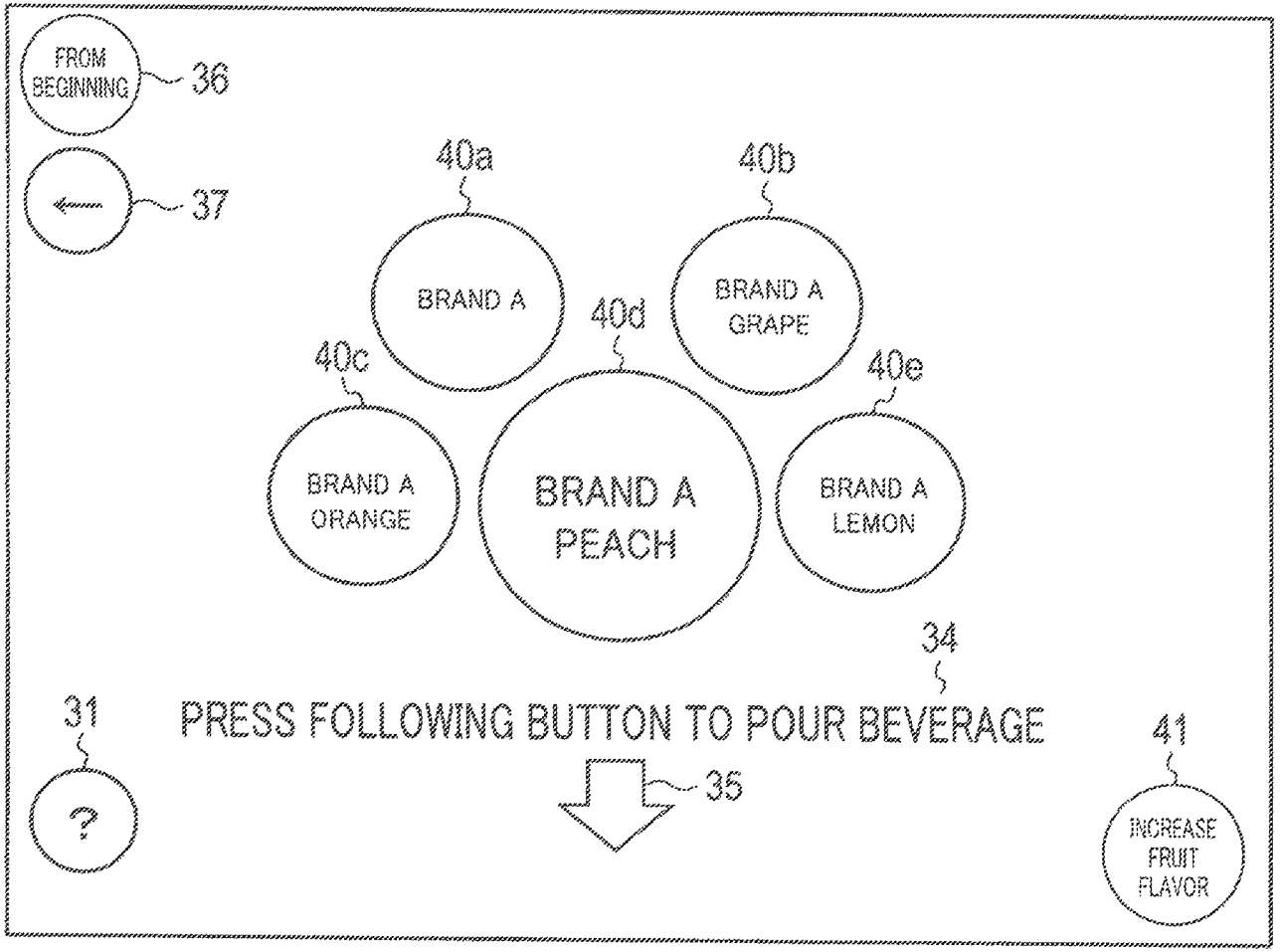
FIG. 9 is a diagram illustrating a display example of a pressing instruction screen according to the beverage supplying apparatus according to the embodiment of the present invention.

A display example of the image corresponding to a pressing instruction including this image is shown in FIG. 9. FIG. 9 is a diagram illustrating an example of the pressing instruction screen when a beverage with a peach flavor of brand A is selected.

As shown in FIG. 9, on this pressing instruction screen, beverage selection button 40*d* is displayed enlarged, and message 34 and arrow 35 are displayed thereunder. Message 34 is a message for notifying the user that the beverage is being discharged. Arrow 35 points to the positions of physical button 3*b*, nozzle 5*b* and container placement area 4*b* as in the case of the aforementioned pressing instruction screen.

Such displaying of arrow 35 allows the user to easily recognize that the physical button to be pressed is physical button 3*b* and also easily recognize that the beverage is supplied at the position of container placement area 4*b* corresponding to physical button 3*b*.

On the pressing instruction screen shown in FIG. 9, topping syrup amount increasing button 41 is displayed at the lower right of the screen. Topping syrup amount increasing button 41 is a button to be pressed when the user wants to increase a fruit flavor.

When topping syrup amount increasing button 41 is pressed, control section 20 causes the topping syrup with the selected fruit flavor (peach flavor in the example in FIG. 9) to be increased by a predetermined amount and discharged.

After that, when the user presses physical button 3*b*, control section 20 causes the selected beverage (here, a peach flavor beverage of brand A, for example) to be discharged from nozzle 5*b* while physical button 3*b* is being pressed. At this time, touch panel 2 may also display an image indicating that the selected beverage is being discharged.

When the user stops pressing physical button 3*b*, control section 20 causes discharging of the beverage from nozzle 5*b* to be stopped. At this time, touch panel 2 may also display an image indicating that discharging of the beverage has ended.

Control section 20 stores information on the beverage for a prescribed time (e.g., on the order of 3 to 15 seconds) from the end of discharging of the beverage, controls touch panel 2 so as to maintain the display of the pressing instruction screen shown in FIG. 9 and waits for the user to press physical button 3*b* again.

When the user presses physical button 3*b* again, control section 20 causes nozzle 5*b* to discharge the same beverage as that discharged immediately before based on the stored information.

This allows the user to easily add a beverage without performing an operation for selecting the aforementioned beverage again.

When a prescribed time (e.g., on the order of 3 to 15 seconds) passes from the end of discharging of the beverage, control section 20 controls touch panel 2 so as to return the display of the pressing instruction screen shown in FIG. 9 to the displaying of the home screen shown in FIG. 6.

Note that a case has been described above where the user selects a peach flavor beverage of brand A from the category "all brands" on the home screen shown in FIG. 6, but the user can also select a peach flavor beverage of brand A from the other categories.

Figure 10:
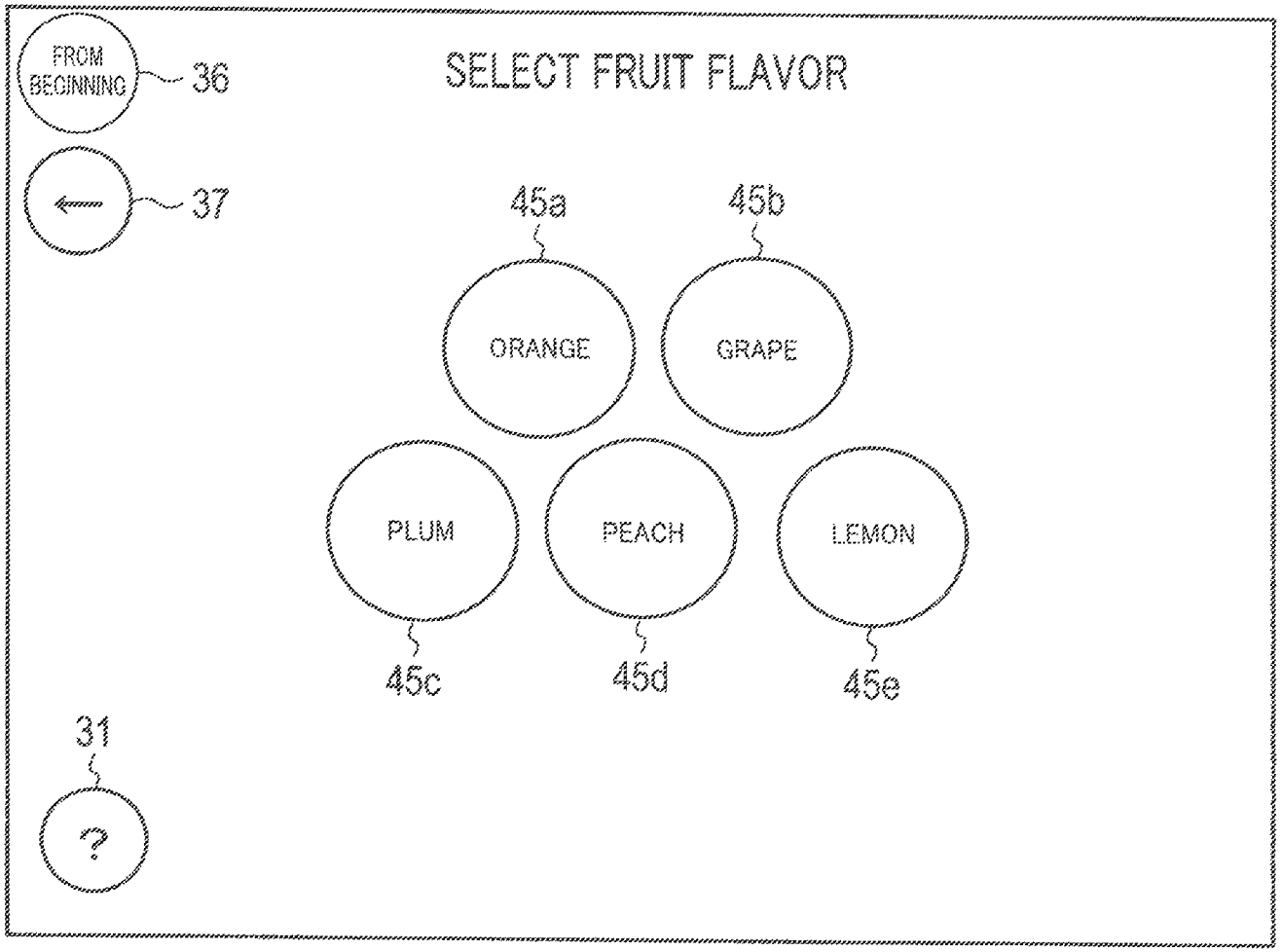
FIG. 10 is a diagram illustrating a display example of a fruit flavor selection screen according to the beverage supplying apparatus according to the embodiment of the present invention.

For example, when the user presses category selection button 30*b* on the home screen shown in FIG. 6, a fruit flavor selection screen as shown in FIG. 10 is displayed on touch panel 2. This fruit flavor selection screen displays fruit flavor selection buttons 45*a* to 45*e* to be pressed by the user to select a fruit flavor for the topping syrup. In the example in FIG. 10, a fruit flavor selected by pressing fruit flavor selection button 45*a* to 45*e* is orange, grape, plum, peach or lemon respectively.

Figure 11:
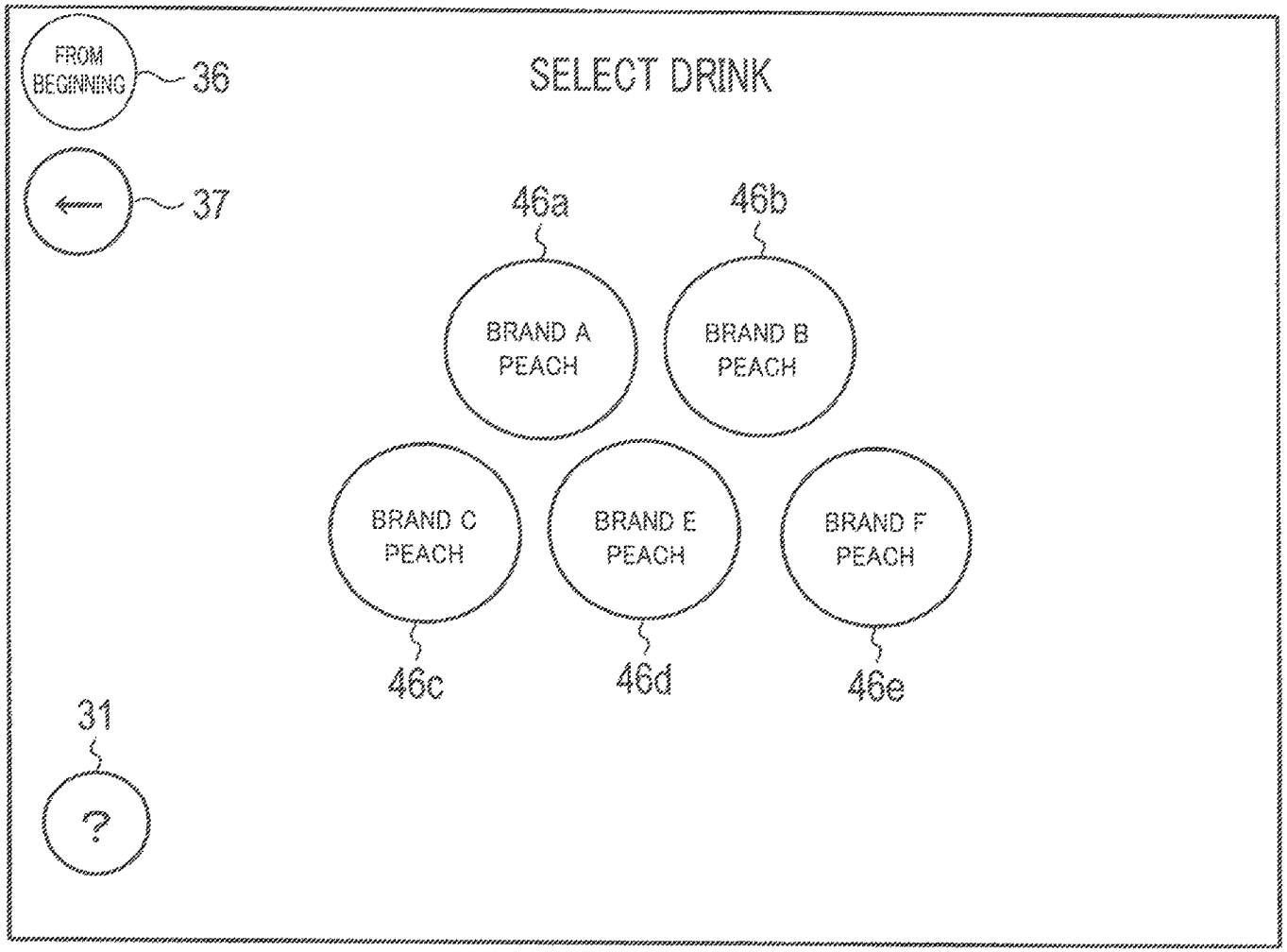
FIG. 11 is a diagram illustrating a display example of a beverage selection screen according to the beverage supplying apparatus according to the embodiment of the present invention.

Here, if the user presses fruit flavor selection button 45*d*, touch panel 2 displays a beverage selection screen as shown in FIG. 11. This beverage selection screen displays beverage selection button 46*a* to 46*e* to be pressed by the user to select a beverage on touch panel 2. In the example in FIG. 11, a beverage selected by pressing beverage selection button 46*a* to 46*e* is a peach flavor beverage of brand A, B, C, E or F. The user presses beverage selection button 46*a*, and can thereby select a peach flavor beverage of brand A. The subsequent screen transition is as described above.

Figure 12:
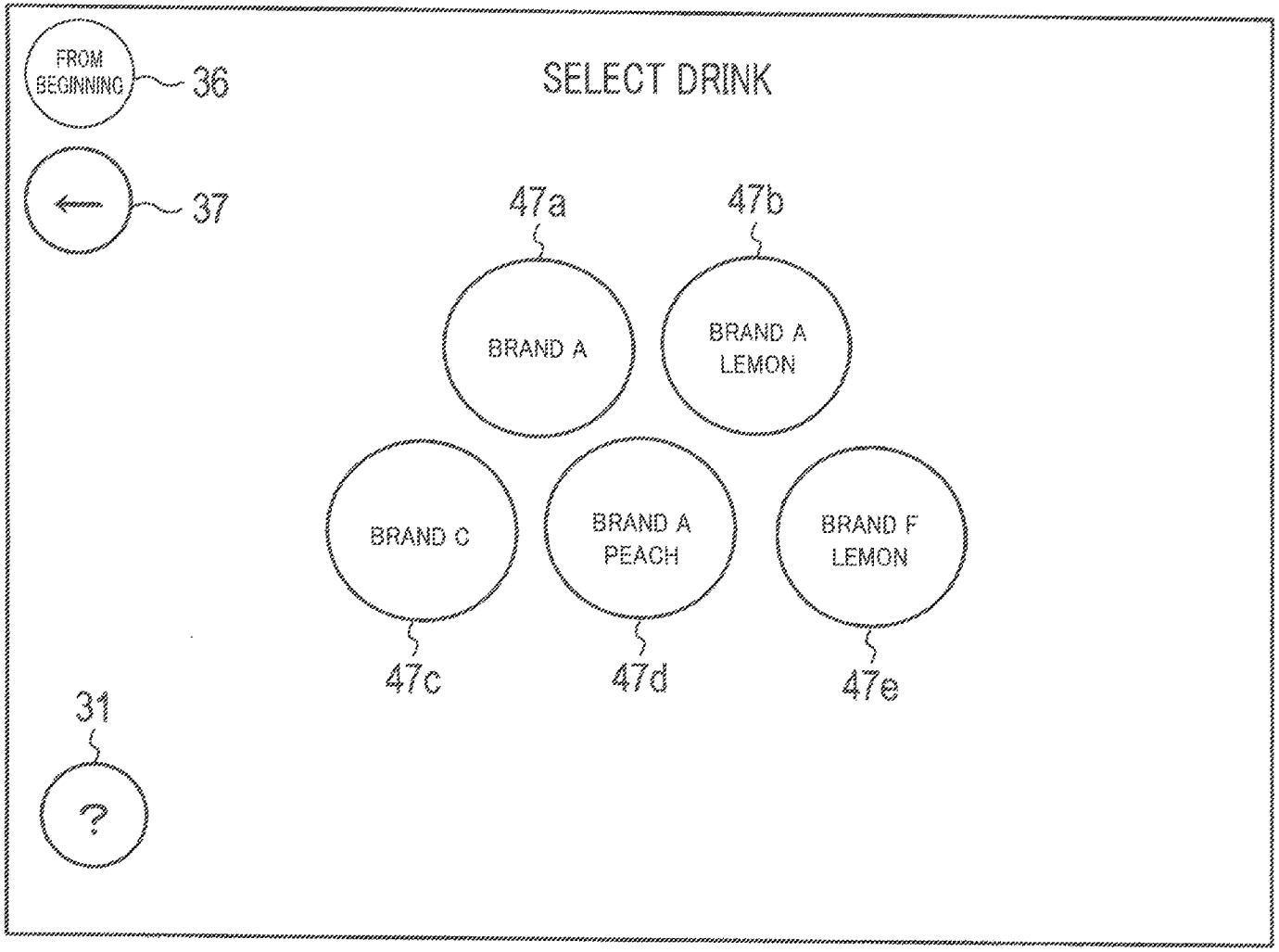
FIG. 12 is a diagram illustrating a display example of a beverage selection screen according to the beverage supplying apparatus according to the embodiment of the present invention.

When, for example, the user presses category selection button 30*c* on the home screen shown in FIG. 6, a beverage selection screen as shown in FIG. 12 is displayed on touch panel 2. This beverage selection screen presents five most popular best beverages to the user and displays beverage selection button 47*a* to 47*e* to be pressed by the user to select a beverage on touch panel 2. The five most popular best beverages are beverages with the cumulative number of sales ranking first to fifth, which will be described later. The user presses beverage selection button 47*d*, and can thereby select a peach flavor beverage of brand A. The subsequent screen transition is the same as that described above.

Note that when, for example, the user presses category selection button 30*d* on the home screen shown in FIG. 6, processing similar to that when aforementioned category selection button 30*c* is pressed is performed. In this case, a predetermined recommended beverage is displayed on the beverage selection screen shown in FIG. 12.

An example of control of the screen display of touch panel 2 executed by control section 20 has been described so far.

Figure 13:
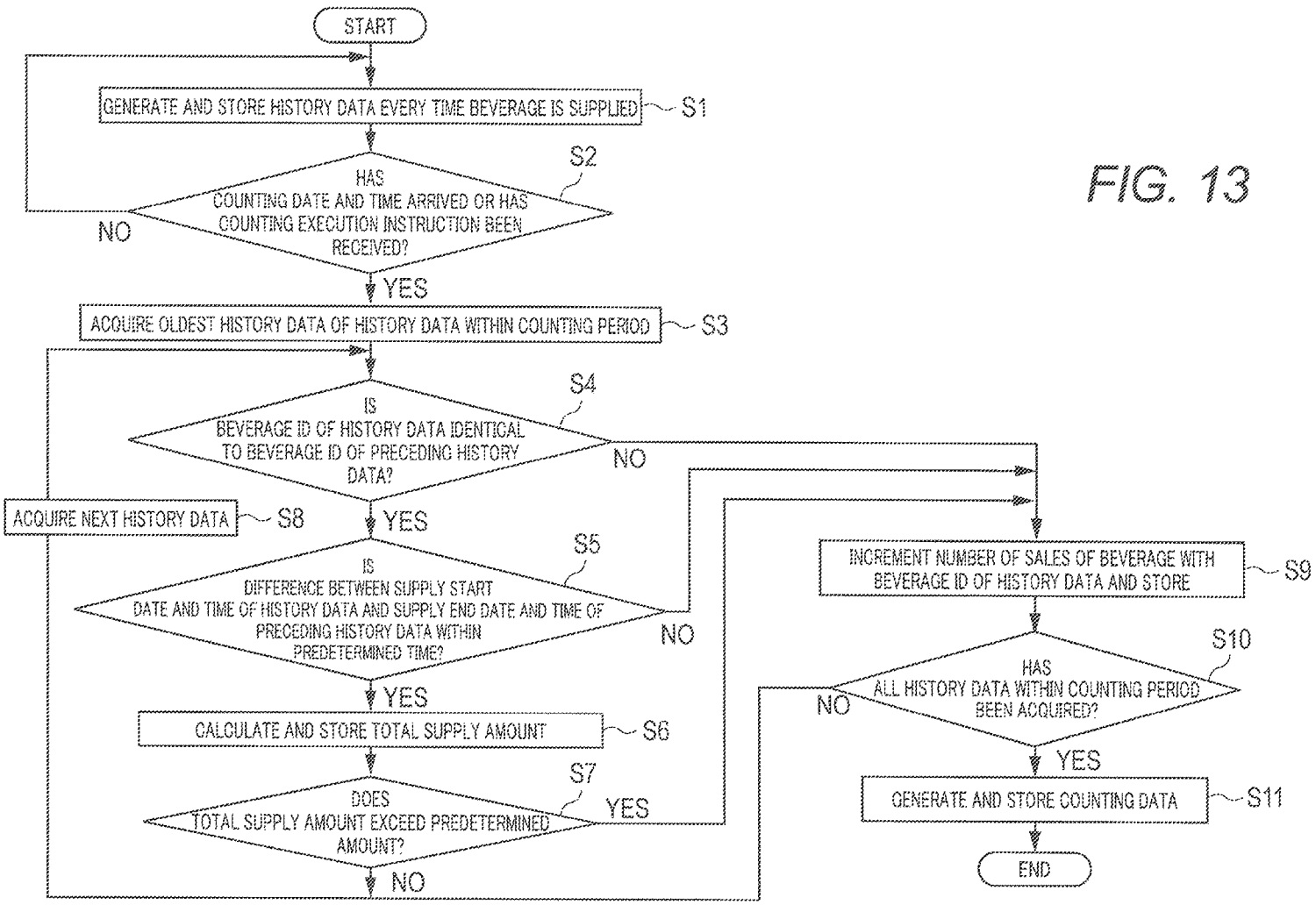
FIG. 13 is a flowchart illustrating an example of counting the number of sales of a beverage of the beverage supplying apparatus according to the embodiment of the present invention.

Next, a counting example of the number of sales of a beverage executed by control section 20 will be described using FIG. 13 to FIG. 15. FIG. 13 is a flowchart illustrating an example of a procedure for counting the number of sales of a beverage of beverage supplying apparatus 100 according to the embodiment of the present invention. FIG. 14 is a diagram illustrating an example of history data 212 generated by beverage supplying apparatus 100 according to the embodiment of the present invention. FIG. 15 is a diagram illustrating an example of counting data 213 generated by beverage supplying apparatus 100 according to the embodiment of the present invention.

First, every time a beverage is supplied, control section 20 generates history data 212 showing a history of beverage supplied and causes storage section 21 to store the history (step S1).

Here, an example of history data 212 will be described using FIG. 14. FIG. 14 illustrates an example of a plurality of pieces of history data 212 registered with storage section 21.

As shown in FIG. 14, each piece of history data 212 includes information on data ID, supply start date and time, supply end date and time, beverage ID, fruit amount increasing flag, and supply amount.

Data ID is identification information of history data 212. History data 212 is generated by registering the information on a supply start date and time, supply end date and time, beverage ID, fruit amount increasing flag and supply amount which will be described hereinafter in association with data ID. Note that data ID is, for example, an integer and assigned as a serial number.

The supply start date and time is the date and time at which a beverage supply is started, that is, the date and time at which control section 20 starts exercising supply control of the aforementioned beverage. The supply start date and time is expressed, for example, by year, month, day, hour, minute, and second.

The supply end date and time is the date and time at which a beverage supply is ended, that is, the date and time at which control section 20 ends supply control of the aforementioned beverage. The supply end date and time is expressed, for example, by year, month, day, hour, minute, and second. Note that instead of the supply end date and time, a beverage discharge time measured by a timer (not shown) may also be registered. In this case, the supply end date and time can be easily calculated from the supply start date and time and the discharge time.

Beverage ID is identification information of a supplied beverage. This beverage ID is predetermined for each beverage selectable on the beverage selection screen shown, for example, in FIG. 8, FIG. 11 or FIG. 12.

The fruit amount increasing flag is a value indicating whether or not an increased amount of a topping syrup is supplied in addition to a normal supply amount by pressing topping syrup amount increasing button 41. When a supply of an increased amount of topping syrup (hereinafter referred to as "topping syrup amount increasing supply") is executed, control section 20 registers value "1" indicating that the executed supply is a topping syrup amount increasing supply in association with data ID. On the other hand, when a topping syrup amount increasing supply is not executed, control section 20 registers value "0" indicating that the executed supply is not a topping syrup amount increasing supply in association with data ID.

The supply amount is an amount of beverage supplied (unit is ml). For example, a flowmeter (not shown) that generates a pulse every time a unit amount of diluted water and/or carbonated water passes is provided on a downstream side of water solenoid valve 23 and/or carbonated water solenoid valve 24. Control section 20 counts pulses generated from the flowmeter, and thereby detects flow rates of diluted water, carbonated water, main syrup and topping syrup sent from the respective nozzles. Control section 20 registers the amount of beverage supplied calculated based on the flow rate detection result in association with data ID.

An example of history data 212 has been described so far. In the present embodiment, the number of sales is counted for each beverage based on aforementioned history data 212. However, history data 212 also includes data generated in correspondence with an additional supply executed after a supply of a predetermined beverage and if the number of sales is counted based on such history data 212, the numbers of sales corresponding to the same user may overlap, thus preventing accurate counting of the number of sales. In the present embodiment, processing in steps S4 to S7 which will be described later is performed so that history data 212 generated in correspondence with an additional supply is not included in the counting of the number of sales. Hereinafter, the flowchart in FIG. 13 will be described again.

After the processing in step S1, control section 20 determines whether or not a counting date and time has arrived or whether or not a counting execution instruction has been received (step S2).

The counting date and time is a date and time predetermined as timing at which the number of sales is counted. The counting date and time is set, for example, by an administrator of beverage supplying apparatus 100 of a beverage maker, a store or the like and stored in storage section 21. Control section 20 reads data of the counting date and time from storage section 21 and determines, when a current date and time measured by clock means (not shown) coincides with the counting date and time, that the counting date and time has arrived.

Note that the counting date and time may also be calculated by control section 20 based on, for example, a counting period (e.g., one hour) set by the administrator of beverage supplying apparatus 100. In this case, the counting date and time corresponds to a date and time after N (N is an integer equal to or greater than 1) times the counting period from a predetermined date and time.

The counting execution instruction refers to an instruction for counting the number of sales. For example, the administrator of beverage supplying apparatus 100 can operate the counting execution instruction at desired timing on touch panel 2 or the like. When the counting execution instruction is operated on touch panel 2, control section 20 determines that the counting execution instruction has been received.

As a result of the determination in step S2, if the counting date and time has not arrived and the counting execution instruction has not been received (step S2: NO), the processing in step S1 is executed again.

On the other hand, as a result of the determination in step S2, if the counting date and time has arrived or the counting execution instruction has been received (step S2: YES), control section 20 acquires oldest history data of history data 212 within the counting period from storage section 21 (step S3).

Here, a specific example of processing of acquiring history data 212 in step S3 will be described using FIG. 14. For example, when the counting period is set to one hour and 12 o'clock on Jul. 10, 2014 arrives which is the counting date and time, control section 20 specifies history data 212 with data ID 11 to data ID 120 where the supply start date and time ranges from 11 o'clock to 12 o'clock in FIG. 14. Control section 20 acquires history data 212 with data ID 11 which is an oldest supply start date and time of history data 212 with data ID 11 to data ID 120.

History data 212 acquired in this way becomes determination targets in steps S4, S5 and S7 which will be described later.

Next, control section 20 determines whether or not beverage ID of history data 212 which is the determination target is identical to beverage ID of preceding history data 212 (step S4). Here, history data 212 which becomes the determination target is data acquired in step S3 or data acquired in step S8 which will be described later.

Preceding history data 212 is history data 212 which is earlier (past) than the supply start date and time of history data 212 which is the determination target and which has a supply end date and time closest to the supply start date and time thereof.

Here, a specific example of determination in step S4 will be described using FIG. 14.

When, for example, history data 212 which is the determination target is data with data ID 11, control section 20 determines whether or not beverage ID of history data 212 with data ID 11 is identical to beverage ID of history data 212 with data ID 10. In this case, as shown in FIG. 14, since beverage ID is "001" and "003," control section 20 determines that beverage IDs of both beverages are not identical.

When, for example, history data 212 which is the determination target is data with data ID 12, control section 20 determines whether or not beverage ID of history data 212 with data ID 12 is identical to beverage ID of history data 212 with data ID 11. In this case, as shown in FIG. 14, since both beverage IDs are "003," control section 20 determines that both beverage IDs are identical.

Thus, in step S4, it is determined whether or not the beverage supplied in the beverage supply indicated by history data 212 which is the determination target is identical to the beverage supplied in the beverage supply indicated by preceding history data 212.

As a result of the determination in step S4, if both beverage IDs are not identical (step S4: NO), that is, the beverage supplied in the beverage supply indicated by history data 212 which is the determination target is different from the beverage supplied in the beverage supply indicated by preceding history data 212, the processing in step S9 is executed. Step S9 will be described later.

On the other hand, as a result of the determination in step S9, if both beverage IDs are identical (step S4: YES), that is, the beverage supplied in the beverage supply indicated by history data 212 which is the determination target is identical to the beverage supplied in the beverage supply indicated by preceding history data 212, the processing in step S5 is executed.

More specifically, control section 20 determines whether or not a difference between the supply start date and time of history data 212 which is the determination target and the supply end date and time of preceding history data 212 (hereinafter referred to as "supply interval") is within a predetermined time (step S5).

The above-described predetermined time is, for example, a time required to return from the display of the pressing instruction screen after a supply end of a beverage (e.g., see FIG. 9) to the display of the beverage selection screen of the home screen (e.g., see FIG. 6), and is 3 to 15 seconds. This predetermined time is set, for example, by the administrator of beverage supplying apparatus 100.

Here, a specific example of the determination in step S5 will be described using FIG. 14.

When, for example, history data 212 which is the determination target is data with data ID 12, control section 20 determines whether or not the supply interval between the supply start date and time of history data 212 with data ID 12 and the supply end date and time of history data 212 with data ID 11 is within a predetermined time (e.g., 5 seconds). In this case, as shown in FIG. 14, since the supply interval is 10 seconds, control section 20 determines that the supply interval is not within the predetermined time.

When, for example, history data 212 which is the determination target is data with data ID 13, control section 20 determines whether or not the supply interval between the supply start date and time of history data 212 with data ID 13 and the supply end date and time of history data 212 with data ID 12 is within a predetermined time (e.g., 5 seconds). In this case, as shown in FIG. 14, since the supply interval is 3 seconds, control section 20 determines that the supply interval is within a predetermined time.

Thus, in step S5, it is determined whether or not the beverage supply indicated by history data 212 which is the determination target is a supply executed after returning to the home screen. In other words, it is determined whether or not the beverage supply indicated by history data 212 which is the determination target is a beverage supply executed while the pressing instruction screen shown in FIG. 9 is being displayed.

As a result of the determination in step S5, if the supply interval is not within a predetermined time (step S5: NO), that is, if the beverage supply indicated by history data 212 which is the determination target is a supply executed after returning to the home screen, the processing in step S9 is performed. Step S9 will be described later.

On the other hand, as a result of the determination in step S5, if the supply interval is within the predetermined time (step S5: YES), that is, if the beverage supply indicated by history data 212 which is the determination target is not a supply executed after returning to the home screen (in other words, if the beverage supply indicated by history data 212 which is the determination target is a supply executed while the pressing instruction screen is being displayed), the processing in step S6 is performed.

More specifically, control section 20 calculates a total supply amount and causes storage section 21 to store the information on the calculated total supply amount (step S6). The total supply amount is a value obtained by totaling supply amounts of a plurality of pieces of history data registered temporally continuously among a plurality of pieces of history data having identical beverage ID and whose supply interval is within a predetermined time.

Here, a specific example of the calculation in step S6 will be described using FIG. 14. Hereinafter, as shown in FIG. 14, a case will be described where in the case of history data 212 with data IDs 12, 13 and 14, beverage IDs are identical, the supply interval is within a predetermined time (within 5 seconds), and further history data 212 with data ID 12, 13 and 14 are registered temporally continuously.

When, for example, history data 212 which is the determination target is data with data ID 13, control section 20 sums up supply amount 260 ml of history data 212 with data ID 12 and supply amount 80 ml of history data 212 with data ID 13, and causes storage section 21 to store information of resultant total supply amount 340 ml.

When, for example, history data 212 which is the determination target is data with data ID 14, control section 20 sums up total supply amount 340 ml and supply amount 160 ml of history data 212 with data ID 14, and causes storage section 21 to store information of resultant total supply amount 500 ml.

Next, control section 20 determines whether or not the total supply amount stored in storage section 21 exceeds a predetermined amount (step S7).

The above-described predetermined amount is, for example, a capacity of a container, and is set by the administrator of beverage supplying apparatus 100.

Here, a specific example of the determination in step S7 will be described using FIG. 14.

When, for example, history data 212 which is the determination target is data with data ID 13, control section 20 determines whether or not aforementioned total supply amount 340 ml exceeds a predetermined amount (e.g., 380 ml). In this case, control section 20 determines that the total supply amount does not exceed the predetermined amount.

When, for example, history data 212 which is the determination target is data with data ID 14, control section 20 determines whether or not aforementioned total supply amount 500 ml exceeds a predetermined amount (e.g., 380 ml). In this case, control section 20 determines that the total supply amount exceeds the predetermined amount.

As a result of the determination in step S7, if the total supply amount exceeds the predetermined amount (step S7: YES), that is, if the total supply amount exceeds the capacity of the container, the processing in step S9 is performed. Step S9 will be described later. Note that when the total supply amount exceeds the capacity of the container, control section 20 initializes the stored total supply amount to 0.

On the other hand, as a result of the determination in step S7, if the total supply amount does not exceed the predetermined amount (step S7: NO), that is, the total supply amount does not exceed the capacity of the container, the processing in step S8 is performed. More specifically, control section 20 acquires next history data 212 and considers it as a new determination target (step S8). Next history data 212 is, for example, history data 212 having a supply start date and time which is after (future) the supply end date and time of history data 212 which is the determination target and closest to the supply end date and time thereof.

In this way, when the beverage supplied in the beverage supply indicated by history data 212 which is the determination target is the same beverage supplied in the beverage supply indicated by preceding history data 212 (step S4: YES), the beverage supply indicated by history data 212 which is the determination target is not executed after returning to the home screen (step S5: YES), and the total supply amount does not exceed the capacity of the container (step S7: NO), control section 20 regards the beverage supply indicated by history data 212 which is the determination target as an additional supply and prevents the beverage supply from being included in the counting of the number of sales in step S9.

On the other hand, when the beverage supplied in the beverage supply indicated by history data 212 which is the determination target is different from the beverage supplied in the beverage supply indicated by preceding history data 212 (step S4: NO) or when the beverage supply indicated by history data 212 which is the determination target is performed after returning to the home screen (step S5: NO) or when the total supply amount exceeds the capacity of the container (step S7: YES), control section 20 does not regard the beverage supply indicated by history data 212 which is the determination target as an additional supply, increments the number of sales of beverage ID of history data 212 which is the determination target and causes storage section 21 to store it (step S9).

Next, control section 20 determines whether or not all history data 212 within the counting period has been acquired (step S10). For example, as described above, when history data 212 with data ID 11 to data ID 120 is specified as history data 212 within the counting period in step S3, control section 20 determines whether or not all history data 212 with data ID 11 to data ID 120 has been acquired.

As a result of the determination in step S10, if all history data 212 within the counting period has not been acquired (step S10: NO), control section 20 acquires next history data 212 (step S8).

On the other hand, as a result of the determination in step S10, if all history data 212 within the counting period has been acquired (step S10: YES), control section 20 generates counting data 213 based on the number of sales for each stored beverage ID and causes storage section 21 to store counting data 213 (step S11).

Here, an example of counting data 213 will be described using FIG. 15. FIG. 15 is a diagram illustrating an example of counting data 213 registered with storage section 21. Note that FIG. 15 shows only one piece of counting data 213, but storage section 21 may store a plurality of pieces of counting data 213 generated every time counting is performed.

As shown in FIG. 15, counting data 213 includes information on data ID, counting period, beverage ID and cumulative number of sales.

Data ID is identification information of counting data 213. Information on the counting period, beverage ID and cumulative number of sales is registered in association with data ID and counting data 213 is thereby generated. Note that data ID is, for example, an integer and assigned as a serial number.

The counting period is a period during which the number of sales is counted. In the example in FIG. 15, the counting period is one hour from 11 o'clock to 12 o'clock on Jul. 10, 2014 described in FIG. 13. Note that the unit of the counting period is not limited to one hour, and it may be, for example, 24 hours, 7 days, 14 days, 30 days or the like.

Beverage ID is the same as beverage ID of aforementioned history data 212.

The cumulative number of sales is a cumulative value of the number of sales. That is, the cumulative number of sales is a total value of the number of sales counted by control section 20 for each beverage in step S8 in FIG. 13.

An example of counting data 213 has been described so far. Counting data 213 is used to generate, for example, the aforementioned beverage selection screen in FIG. 12. That is, control section 20 specifies top five beverage IDs in the cumulative number of sales of counting data 213 and generates a beverage selection screen including beverage selection buttons 47*a* to 47*e* to select the specified five beverage IDs.

Note that counting data 213 may also be used for purposes other than the generation of the above beverage selection screen. For example, the administrator of beverage supplying apparatus 100 may cause counting data 213 stored in storage section 21 to be read into an information processing apparatus such as a personal computer, cause the apparatus to display counting data 213, and thereby analyze the sales result so as to be used for future sales planning or the like.

An example of counting the number of sales of a beverage executed by control section 20 has been described so far.

As described above, according to the present embodiment, by counting the number of sales in such a way that a beverage supply by an additional supply is not included in the number of sales, it is possible to obtain an accurate cumulative number of sales for each beverage. Therefore, the administrator or the like of beverage supplying apparatus 100 can accurately grasp the popularity of a beverage.

The embodiment of the present invention has been described so far, but the present invention is not limited to the above embodiment and various modifications can be made.

For example, although the processing of determining the number of sales based on whether or not a total supply amount exceeds a predetermined amount has been described in steps S6 and S7 in FIG. 13, such processing may be omitted.

Furthermore, when, for example, it is determined in step S4 in FIG. 13 that beverage ID of history data is identical to beverage ID of preceding history data (step S4: YES), control section 20 may perform the following determination processing instead of steps S5 to S7. For example, control section 20 determines whether or not the supply amount of history data which is the determination target has reached a specified amount. As a result of this determination, if the supply amount has not reached the specified amount, control section 20 performs the above processing in step S8 and when the supply amount has reached the specified amount, control section 20 performs the above processing in step S9.

Note that in the above description, the above determination processing is performed instead of steps S5 to S7 but the above determination processing may be performed, for example, between step S4 and step S5. In this case, control section 20 proceeds to the determination processing in step S5 when it determines that the supply amount has not reached the specified amount in the above determination processing.

The disclosure of Japanese Patent Application No. 2014-223605, filed on Oct. 31, 2014, including the specification, drawings and abstract is incorporated herein by reference in its entirety.

INDUSTRIAL APPLICABILITY

The present invention is useful for a beverage supplying apparatus that supplies a beverage.

REFERENCE SIGNS LIST

1 Front door
2 Touch panel
3*a*, 3*b*, 3*c* Physical button
4*a*, 4*b*, 4*c* Container placement area
5*a*, 5*c* Diluted water nozzle
5*b* Nozzle
6, 7 Bag-in-box
8 Cleaning filter
9 Carbon dioxide gas cylinder
10 Syrup tank
11, 12, 14, 15, 16 Blade tube
13 Gas regulator
20 Control section
21 Storage section
23 Water solenoid valve
24 Carbonated water solenoid valve
25 Syrup solenoid valve
26, 27 BIB tube pump
30*a* to 30*d* Category selection button
31 Help button
32 Water button
33 Carbonated water button
34 Message
35 Arrow
36, 37 Return button
39*a* to 39*j* Brand selection button
40*a* to 40*e*, 46*a* to 46*e*, 47*a* to 47*e* Beverage selection button
41 Topping syrup amount increasing button
45*a* to 45*e* Fruit flavor selection button
50, 51 Syrup nozzle
52 Carbonated water nozzle
100 Beverage supplying apparatus
210 Control data
211 Table
212 History data
213 Counting data

The invention claimed is:

1. A beverage supplying apparatus that supplies a plurality of types of beverages, the apparatus comprising:

a button for receiving an instruction operation for instructing supply of a beverage selected from among the plurality of types of beverages;

a controller that causes the selected beverage to be discharged from a nozzle while the button is receiving the instruction operation; and a storage that stores a number of sales for each type of the plurality of beverages, wherein:

the controller increments the number of sales for the selected beverage of a same type by one sale when the selected beverage of the same type is supplied continuously and an interval during which the selected beverage of the same type is supplied continuously is longer than a predetermined period, and the controller does not increment the number of sales for the selected beverage of a same type when the interval during which the selected beverage of the same type is supplied continuously is shorter than the predetermined period.

2. A beverage supplying apparatus that supplies a plurality of types of beverages, the apparatus comprising:

a button for receiving an instruction operation for instructing a supply of a beverage selected from among the plurality of types of beverages;

a controller that causes the selected beverage to be discharged from a nozzle while the button is receiving the instruction operation; and a storage that stores a number of sales for each type of the plurality of beverages, wherein:

the controller increments the number of sales for the selected beverage of a same type by one sale when the selected beverage of the same type is supplied continuously and an interval during which the selected beverage of the same type is supplied continuously is longer than a predetermined period, or the interval during which the selected beverage of the same type is supplied continuously is shorter than the predetermined period and a total amount of the selected beverage of the same type supplied continuously exceeds a predetermined value, and the controller does not increment the number of sales for the selected beverage of a same type when the interval during which the selected beverage is supplied continuously is shorter than the predetermined period and the total amount of the selected beverage of the same type supplied continuously is less than the predetermined value.

* * * * *